United States Patent [19]

Michlmayr

[11] 4,179,361

[45] Dec. 18, 1979

[54] SORBENT REGENERATION IN A PROCESS FOR REMOVING SULFUR-CONTAINING IMPURITIES FROM MINERAL OILS

[75] Inventor: Manfred J. Michlmayr, Orinda, Calif.

[73] Assignee: Chevron Research Company, San Francisco, Calif.

[21] Appl. No.: 960,501

[22] Filed: Nov. 13, 1978

[51] Int. Cl.[2] ..... C10G 29/16; C10G 25/12

[52] U.S. Cl. ..... 208/244; 208/246; 252/411 S; 252/416

[58] Field of Search ..... 208/244, 246; 252/416, 252/420, 411 S

[56] References Cited

U.S. PATENT DOCUMENTS

| | | | |
|---|---|---|---|
| 2,951,034 | 8/1960 | Stuart | 208/244 |
| 2,987,486 | 6/1961 | Carr | 252/420 |
| 3,132,091 | 5/1964 | Young | 252/420 |
| 3,367,862 | 2/1968 | Mason et al. | 208/244 |
| 3,557,019 | 1/1971 | Van Driesen | 252/416 |
| 3,812,057 | 5/1974 | Morgan et al. | 252/416 |

*Primary Examiner*—George Crasanakis

*Attorney, Agent, or Firm*—D. A. Newell; R. H. Davies; D. L. Hagmann

[57] ABSTRACT

Mineral oils containing minor or residual amounts of sulfur-containing impurities are upgraded by contact thereof with a cobalt oxide-supported sorbent under sulfur-sorbing conditions. The sorbent is regenerated by a set of sequential treatment steps.

7 Claims, No Drawings

SORBENT REGENERATION IN A PROCESS FOR REMOVING SULFUR-CONTAINING IMPURITIES FROM MINERAL OILS

BACKGROUND OF THE INVENTION

This invention relates to the separation of sulfur compounds from mineral oils, and more particularly to the use of a special sorbent and to its regeneration after use.

Generally, sulfur occurs in petroleum and syncrude stocks, tar sand oil, shale oil and the like, in such forms as organic mercaptans, sulfides, disulfides, and as a part of ring compounds such as thiophene, benzothiophene, and dibenzothiophenes and the like impurities. Usual practice in petroleum and syncrude refining is to remove at least the major portion of these impurities from the oil or from product fractions obtained from the oil, such as straight-run, gas oil, vacuum gas oil or the like fractions. Normally sulfur removal is by treatment using hydrogen and a catalyst under well-known hydrotreating, hydrofining and/or hydrodesulfurizing conditions. In general, the cost of sulfur removal by such treatments in terms of hydrogen consumed, light gas make, reduced catalyst life and the like costs, increases markedly with increasing degree of sulfur removal. When the mineral oil originally has but a minor content of sulfur or has been hydroprocessed to such a low sulfur content, for example in the range from 1 to 500 ppmw, catalytic hydroprocessing or further hydroprocessing may be uneconomical in terms of efficient usage of a costly catalyst. Consequently, there is a need for an effective means for removing a minor amount of sulfur-containing impurities from a mineral oil, especially of the residual impurities in a hydroprocessed oil. These impurities in general, or at least in large part, are of the thiophene type, for which relatively severe process conditions are usually required for their hydrogenative desulfurization.

It is an object herein to provide an effective regenerative sorbent process for removing residual and/or trace amounts of sulfur-containing impurities from a mineral oil.

SUMMARY OF THE INVENTION

A non-hydrogenative process is provided for upgrading a mineral oil feed containing a minor amount of sulfur-containing impurities. In the process, a sulfur-containing sorbent and a resulting oil are produced by contacting the feed and a particulate sorbent, for example in a fixed-bed or fluid-bed mode, at a temperature in the range of from about 250° to 500° C. and a liquid hourly space velocity in the range of from about 0.1 to 20. The contacting is carried out in the substantial absence of water, that is, under oleaginous, in contrast to essentially aqueous as required for hydrolysis, conditions. The sorbent used consists essentially of a minor amount of cobalt oxide disposed upon porous alumina sized as particles normally employed for fixed-bed or fluid-bed usage. The oil resulting from the contacting has, relative to the feed, a substantially (at least 50%) lower content of the impurities. For convenience, and following custom, the content of impurities is expressed as sulfur in parts thereof per million parts of the total mixture, for example feed or resulting oil.

The afore-described sulfur-containing sorbent and resulting oil are separated, the latter for recovery and the former for continued use or ultimately, when its capacity for sorbing sulfur has been reached, for regeneration in a sequence of steps or treatments, including:

(a) oxidizing at least a major portion of the sulfur content of said sulfur-containing sorbent by heating said sorbent in the presence of molecular oxygen at a temperature in the range of from about 200° to 800° C. for a period in the range of from about 0.5 to 2 hours;

(b) heating said oxidized sorbent resulting from step (a) at a temperature in the range of from about 700° to 1000° C. for a period in the range of from about 0.2 to 5 hours; and (c) contacting the heated sorbent resulting from step (b) with wet air or steam at a temperature in the range of from about 400° to 600° C. for a period in the range of from about 0.5 to 2 hours.

In another aspect of the invention, sulfur-containing impurities in a hydrocarbon feed are removed in a two-stage sorption process. In the first stage, the feed contains more than 50 and less than about 500 ppmw of sulfur-containing impurities. This content of impurities is reduced to an amount in the range of from about 1 to 100, preferably 1 to 30, ppmw sulfur by contacting the feed with a copper-containing sorbent under known sorbing conditions for removing such impurities from a hydrocarbon mixture [e.g., using (1) copper chromite, metal or oxide, disposed upon an inert support as the sorbent, for example alumina, silica-alumina, magnesia, or the like; (2) a temperature in the range 0° to 400° C., and (3) with the feed in the liquid, gas, or both phases]. The resulting upgraded oil has a content of sulfur-containing impurities which is typically less than 50% of that of the feed and is usually in the range of from about 1 to 100 ppmw. It is then processed pursuant to the regenerative sorption process described above.

Other and preferred aspects of the invention and obvious variations thereof will be clear from the examples and description to follow.

EMBODIMENT

In a preferred embodiment, sulfur-containing impurities are partially removed from a reformer fraction, for example a $C_7$–$C_{10}$ fraction separated from a hydrofined gasoline-boiling-range straight-run refining product. The hydrofining is carried out under conventional hydrofining conditions, for example:

| | |
|---|---|
| Temperature, °C. | 250–500 |
| Pressure, Atm. g. | 10–120 |
| Feed Rate, V/V/Hr | 0.1–20 |
| Hydrogen Rate, SCM/K1 | 50–2000 |

using a commercially available hydrocarbon hydrofining catalyst, for example cobalt-molybdenum disposed upon porous alumina. These conditions, of themselves, are of course not inventive. However, for present purposes and in their use, the severity of the conditions (usually temperature) are controlled so as to obtain a product having a residual sulfur impurities content of about 30–40 ppmw. Under conventional practices, the hydrofining process conditions are maintained such that the sulfur level of the product is about 1 ppmw. In terms of the plant size, requirements for a given throughput of feed, that for a 30–40 ppmw product sulfur level process is much smaller than that for the 1-ppmw-level product.

Because of savings in hydrofining plant size and of other advantages, including a more sulfur impurities-free final product, it is advantageous to remove the aforementioned residual impurities in a two-stage regenerative sorption process, in neither of which stages hydrogen is added to the hydrocarbon feed, that is, a non-hydrogenative two-stage sorption process.

In the first stage of the sorption section of the process herein, the residual sulfur-containing impurities (30–40 ppmw) in the product from the above-described hydrofining stage) are substantially removed (e.g., to an amount in the 1–5 ppmw range) by contacting the product with a copper-containing regenerative sorbent under sulfur-impurity-sorbing conditions (for example, see U.S. Pat. No. 4,008,174 [−174] [R. L. Jacobson et al], which is incorporated herein by reference). The resulting low-sulfur product still contains residual sulfur of the thiophene type, which may be from 1–20 ppmw. While this content of sulfur is a hydrocarbon mixture may seem negligible, it is excessive where the mixture is to be reformed by contact thereof with a chlorided reforming catalyst of the platinum-rhenium-alumina type. Therefore, a second sorption stage is required in order to effectively reduce the content of thiophene-type impurities to a satisfactory level. Regeneration of the copper-containing sorbent is by any suitable conventional means, preferably in the manner described in the U.S. Pat. No. 4,008,174 cited above.

The low-sulfur product from the above-described sorption step is, for practical purposes, essentially fully desulfurized by contacting it with a sorbent having, in general, special affinity for thiophene-type impurities under suitable contacting conditions. The sorbent is a composite of cobalt oxide and porous alumina, the latter having a surface area in the 200–500-$m^2/g$ range and the former being about 10 weight percent thereof.

The contacting of the low-sulfur feed with the cobalt oxide-alumina composite is carried out using a bed or particulate sorbent in a fixed-bed reactor at a temperature of about 425° C., a liquid hourly space velocity, V/V/Hr, of about 0.2, and atmospheric pressure. Initially, the effluent product from the contacting contains no detectable sulfur. As the capacity of the sorbent for sulfur is approached, sulfur is detected and its use is discontinued. The sorbent is regenerated when a predetermined sulfur content is noticeable in the effluent product stream, for example 0.1 ppmw.

For the regeneration, the feeding of the hydrocarbon into the fixed-bed reactor is discontinued and, using an inert purge gas, for example nitrogen, residual hydrocarbons are swept from the reactor. In the first step of the regeneration, spent sorbent is then calcined in air by maintaining the bed at a temperature of about 315° C. while passing a stream of air through it. After a period of 0.5–1 hour, the sulfur content of the spent sorbent is substantially completely oxidized to sulfate and the composite comprises cobalt sulfate disposed upon porous alumina.

For the next step of the regeneration, the oxidized sorbent is maintained at a temperature of about 950° C. for a period of about 1 hour. During this period, sulfur oxide dissociation products are desirably removed from the reactor by passing a stream of nitrogen gas through the fixed bed. As an alternative, the dissociation products may be removed by maintaining the reactor at a subatmospheric pressure.

Next, the bed temperature is reduced to about 500° C., and while maintaining this temperature a stream of wet air (air saturated with water vapor at ambient conditions) is passed through the bed for a period of about one hour. The bed is now ready for further use in sorbing thiophene-type impurities from the hydrocarbon feed.

The Feed

Distillable hydrocarbons (mineral oils) containing a minor amount of indigenous, residual and/or thiophene-type (thiophenes, substituted thiophenes and thiophene derivatives which are either indigenous to a mineral oil or present in such an oil as a result of processing thereof by known methods such as thermal cracking, hydrocracking, catalytic cracking, coking or the like) sulfur-containing impurities are satisfactory feeds for the process herein. In the case of the combination sorption process described above, the first stage of which employs a copper-containing sorbent, a satisfactory feed contains an amount of sulfur-containing impurites in the range of from about 50 to 500 ppmw. Although feeds containing more than 500 ppmw, for example as much as 1000 ppmw, may be used herein, such as usually more economically desulfurized by other known methods than by sorption by a copper-containing sorbent.

Representative mineral oils herein include, in general, distillates obtained from crude and syncrude oils as well as such oils after processing or partial processing having the aforementioned sulfur-impurities contents, such as gasoline, olefinic cracked gasolines, olefinic coker distillates, kerosene, light cycle oils, and jet fuel boiling-range hydrocarbons and fractions thereof. Other oils suitable for use herein include reformable hydrocarbon mixtures, aromatic hydrocarbon concentrates and the like particular distillable hydrocarbon fractions normally resulting from conventional hydrocarbon processing.

The process herein is especially useful and advantageous for upgrading hydrocarbon feeds which contain olefins. For example, a typical catalytically cracked gasoline (FCC gasoline) or coker distillate may contain 20–50% of olefins and have an octane number of about 90. Such a feed after sulfur removal by a typical hydroforming treatment usually has an octane number of about 65. In the present process, olefins, for practical purposes, are unaffected. The resulting product is, of course, an excellent octane-upgrading blending stock or gasoline.

The Sorbents

In the first stage of the two-stage sorbing mode of the invention, the copper-containing sorbent may be any material known and used in the art of sorbing sulfur-containing impurities from a mineral oil. Per se, these sorbents and their use in sorbing sulfur-containing impurities from an oil are not inventive. Copper disposed upon alumina is a preferred sorbent because it is available commerically and is conveniently regenerable.

In the second sorption stage, sorbents consist essentially of a minor amount of cobalt oxide disposed upon porous alumina. For effective removal of the impurities from the oil, a substantial cobalt-oxide surface must be presented for contact with the oil. Therefore, the alumina upon which the cobalt oxide is disposed must be porous and hence have at least a substantial pore volume, for example in the range of from about 0.3 to 1 and higher cc/gram. While any porous alumina is a satisfactory component of the sorbent, gamma-alumina is preferred. The sorbent may be prepared by any suitable known method, for example impregnation of commerically available alumina using a water-soluble cobalt salt which decomposes upon heating to cobalt oxide, for example cobalt nitrate and the like. The cobalt oxide-alumina sorbent may also contain minor amounts of other refractory oxides, such as magnesia, titania, calcium oxide and the like. Alumina undiluted by other refractory oxide carrier materials is preferred.

The amount of cobalt oxide desirably present in the sorbent may vary. In general, a satisfacory amount is in the range above 5 and below 50, preferably 5 to 30 weight percent.

Cobalt Oxide-Alumina Sorbing Conditions

The contacting in the sorbing of the impurities by the cobalt oxide-alumina sorbent is effected with the feed in the liquid and/or gas phase under conditions as follows:

| | Broad Range | Preferred Range |
|---|---|---|
| Temperature, °C. | 250–500 | 350–450 |
| LHSV, V/V/Hr. | 0.1–2.0 | 0.1–0.5 |

Spent Sorbent Regenerating Conditions

The oxidation of the spent or sulfur-containing sorbent is effected by contacting it with molecular oxygen, air, oxygen-enriched air, and the like gases under conditions as follows:

| | Broad Range | Preferred Range |
|---|---|---|
| Temperature, °C. | 700–1000 | 750–950 |
| Time, Hours | 0.5–2 | 0.5–1 |

The solid residue after dissociating the oxidized sorbent is heated while flowing a stream of wet air, steam or the like into contact therewith under conditions including:

| | Broad Range | Preferred Range |
|---|---|---|
| Temperature, °C. | 400–600 | 450–550 |
| Gas Space Velocity, V/V/Hr | 10–10,000 | 100–1000 |
| Time, Hours | 0.5–2 | 0.5–1 |
| Pressure | 0.5–2 | Atmospheric |

EXAMPLES

The following examples further illustrate certain aspects of the invention.

EXAMPLE 1

A gasoline fraction containing 100 ppmw of thiophene sulfur was contacted with a sorbent which was a composite of porous alumina having disposed thereon, based upon alumina and calculated as metal, 10 weight percent of cobalt oxide. At 426° C. and a liquid hourly space velocity of 0.2, a 98% thiophene removal is accomplished for about 150 hours. Olefins in the feed are not affected. As the space velocity is increased, the thiophene removal is less effective, i.e., about 88% at LHSV=0.4 and about 60% at LHSV=1.0.

EXAMPLE 2

In a replicate of Example 1, the capacity of the sorbent was determined and found to be about 0.6 weight percent of thiophene sulfur. The spent sorbent was regenerated by steps including: (1) calcination thereof in air; (2) heating while maintaining subatmospheric pressure over the heated solid; and (3) passing wet air over the heated solid. This treatment, based upon fresh sorbent, was found to restore about 60% of the capacity which remains substantially constant after subsequent regenerations.

The above Examples 1 and 2 demonstrate that cobalt-alumina sorbents effectively remove thiophene-type impurities from a hydrocarbon feed.

EXAMPLE 3

The activity of a copper chromite-alumina sorbent for removing thiophene-type impurities from a gasoline was tested. For the test a light FCC naphtha was used. It had a total sulfur-containing hydrocarbon impurity content of 420 ppmw (as sulfur), of which a substantial portion was thiophene and thiophene-type impurities. The sorbent was a commercially available composite of copper chromite disposed upon porous alumina. Calculated as copper, it had a copper content of about 10 weight percent. The contacting was carried out at an LHSV of 0.2 and a temperature of 315° C. Only for a short period, about 40 hours, was sulfur removed to a low level; and even during this time, alkyl-substituted thiophenes were not removed. Further, in the case of thiophene, the removal was initially 100%, and then declined steadily, until after 40 hours it was only to the 30% level. Temperature and space velocity changes had virtually no effect upon the removal of thiophene-type impurities from the feed. Similar tests were made with similar results using copper in reduced form.

This example demonstrated that copper-alumina sorbents are not effective for the removal of thiophene-type impurities from a hydrocarbon feed, especially in terms of capacity.

What is claimed is:

1. A non-hydrogenative process for upgrading a mineral oil feed containing a minor amount of sulfur-containing impurities, comprising:

(1) producing a sulfur-containing sorbent and a resulting oil by contacting said feed and a particulate sorbent at a temperature in the range of from about 250° C. to 500° C. and a liquid hourly space velocity in the range of from about 0.1 to 20, said sorbent consisting essentially of a minor amount of cobalt oxide disposed upon porous alumina, and said resulting oil, relative to the feed, having a substantially lower content of said impurities;

(2) separating said resulting oil and sulfur-containing sorbent; and (3) regenerating said sorbent by steps including:

(a) oxidizing at least a major portion of the sulfur content of said sulfur-containing sorbent by heating said sorbent in the presence of molecular oxygen at a temperature in the range of from about 400° to 800° C. for a period in the range of from about 0.5 to 2 hours;

(b) heating said oxidized sorbent resulting from step (a) at a temperature in the range of from about 700° to 1000° C. for a period in the range of from about 0.2 to 5 hours; and (c) contacting the heated sorbent resulting from step (b) with wet air or steam at a temperature in the range of from about 400° to 600° C. for a period in the range of from about 0.5 to 2 hours.

2. A process as in claim 1 wherein at least the major portion of said impurities are of the thiophene type and said amount thereof, calculated as sulfur in parts by weight per million parts of the feed, is in the range of from about 1 to 200 parts.

3. A process as in claim 2 wherein said feed, prior to said contacting with said sorbent, is contacted with a sorbent for sulfur-containing impurities selected from the group consisting of porous copper-containing sorbents, said contacting being under copper sulfur-sorbing conditions.

4. A process as in claim 3 wherein said amount of thiophene-type impurities is in the range of from about 1 to 30 parts.

5. A process as in claim 1 wherein said heating of said oxidized sorbent in step (3a) is carried out under subatmospheric pressure.

6. A process as in claim 1 wherein during at least a portion of said heating in step (3a), a flowing carrier gas is passed into contact with said oxidized sorbent.

7. A process as in claim 1 wherein said feed contains olefins.

* * * * *